US008342886B2

(12) United States Patent
Zhang et al.

(10) Patent No.: US 8,342,886 B2
(45) Date of Patent: Jan. 1, 2013

(54) ELECTRICAL CONNECTOR WITH CONNECTING BARS THEREIN TO REDUCE CROSS TALKING

(75) Inventors: George Huanyi Zhang, Irvine, CA (US); Yu Luo, Shenzhen (CN); Xing-Liang Liu, Shenzhen (CN)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 0 days.

(21) Appl. No.: 13/046,804

(22) Filed: Mar. 14, 2011

(65) Prior Publication Data

US 2012/0238145 A1 Sep. 20, 2012

(51) Int. Cl.
*H01R 24/00* (2011.01)

(52) U.S. Cl. ..... 439/660; 439/723

(58) Field of Classification Search ..... 439/660, 439/721, 723

See application file for complete search history.

(56) References Cited

U.S. PATENT DOCUMENTS

| | | | | |
|---|---|---|---|---|
| 6,746,281 | B1 * | 6/2004 | Zhang | 439/637 |
| 6,824,426 | B1 * | 11/2004 | Spink, Jr. | 439/579 |
| 6,832,931 | B1 * | 12/2004 | Wu | 439/499 |
| 6,832,934 | B1 * | 12/2004 | Zhang | 439/660 |
| 6,942,524 | B2 * | 9/2005 | Wu | 439/637 |
| 6,976,869 | B1 * | 12/2005 | Wu | 439/499 |
| 7,238,054 | B2 * | 7/2007 | Higeta et al. | 439/637 |
| 7,481,657 | B2 * | 1/2009 | Ng et al. | 439/78 |
| 7,497,709 | B1 * | 3/2009 | Zhang | 439/188 |
| 7,553,191 | B2 * | 6/2009 | Su et al. | 439/637 |
| 7,559,796 | B1 * | 7/2009 | Wu | 439/564 |
| 7,585,184 | B2 * | 9/2009 | Su et al. | 439/579 |
| 7,607,930 | B1 * | 10/2009 | Wu | 439/247 |
| 7,654,873 | B2 * | 2/2010 | Luo et al. | 439/731 |
| 7,744,427 | B2 * | 6/2010 | Zhang et al. | 439/660 |
| 7,753,737 | B2 * | 7/2010 | Yang et al. | 439/660 |
| 7,794,273 | B2 * | 9/2010 | Xu et al. | 439/555 |
| 7,909,652 | B2 * | 3/2011 | Yang et al. | 439/660 |
| 8,007,289 | B2 * | 8/2011 | Bandhu et al. | 439/79 |
| 8,011,966 | B1 * | 9/2011 | Tang et al. | 439/638 |
| 8,052,487 | B2 * | 11/2011 | Zhu | 439/695 |
| 8,070,526 | B2 * | 12/2011 | Zhu | 439/660 |
| 8,096,815 | B2 * | 1/2012 | Zhu | 439/83 |
| 2004/0248470 | A1 * | 12/2004 | Wu | 439/637 |
| 2005/0272303 | A1 * | 12/2005 | Wu | 439/499 |
| 2006/0189182 | A1 * | 8/2006 | Higeta et al. | 439/79 |
| 2007/0190831 | A1 * | 8/2007 | Shun et al. | 439/157 |
| 2008/0081514 | A1 * | 4/2008 | Ng et al. | 439/626 |
| 2008/0188136 | A1 * | 8/2008 | Su et al. | 439/660 |
| 2008/0214054 | A1 * | 9/2008 | Su et al. | 439/637 |
| 2009/0068896 | A1 * | 3/2009 | Zhang | 439/626 |

(Continued)

*Primary Examiner* — Ross Gushi
(74) *Attorney, Agent, or Firm* — Wei Te Chung; Ming Chieh Chang

(57) ABSTRACT

An electrical connector includes an insulating housing defining an uninterrupted tongue portion with opposite first surface and second surface and a plurality of contacts loaded in the tongue portion. The first surface defines at least one rib. The plurality of contacts includes a first group of contacts with contacting portions loaded in the first surface at one side of the at least one rib, a second group of contacts with contacting portions loaded in the first surface at another side of the rib and a third group of contacts with contacting portions loaded in the second surface opposite to the at least one rib. Each of the second and third group of contacts is composed of signal contacts and grounding contacts. The grounding contacts of each group unitarily connect with each other by a connecting bar at front distal ends thereof.

16 Claims, 10 Drawing Sheets

U.S. PATENT DOCUMENTS

2009/0130878 A1* 5/2009 Xu et al. ..... 439/157
2009/0221165 A1 9/2009 Buck et al.
2010/0009555 A1* 1/2010 Zhu ..... 439/65
2010/0015836 A1* 1/2010 Zhu ..... 439/329
2010/0055977 A1* 3/2010 Zhu ..... 439/571
2010/0099307 A1* 4/2010 Zhang et al. ..... 439/660
2010/0105249 A1* 4/2010 Bandhu et al. ..... 439/638
2011/0028045 A1* 2/2011 Zhu ..... 439/660
2011/0076865 A1* 3/2011 Luo et al. ..... 439/82
2011/0195605 A1* 8/2011 Zhang et al. ..... 439/638
2011/0230101 A1* 9/2011 Tang et al. ..... 439/638
2011/0269346 A1 11/2011 Casher et al.
2012/0077389 A1* 3/2012 Zhang et al. ..... 439/660
2012/0108109 A1* 5/2012 Zhang et al. ..... 439/629

* cited by examiner

ELECTRICAL CONNECTOR WITH CONNECTING BARS THEREIN TO REDUCE CROSS TALKING

BACKGROUND OF THE INVENTION

1. Field of the Invention

The present invention generally relates to an electrical connector, and more particularly to an electrical connector capable of high speed and backwards compatibility with relative lower high speed.

2. Description of Related Art

Serial Attached SCSI (SAS) is a successor to the parallel SCSI and is also based on serial technology. Besides the advantage of higher speed signal transmission, another most significant advantage is that the SAS interface will also be compatible with SATA drives. In other words, the SATA plug connector can plug directly into a SAS receptacle connector if supported in the system. By this way, the system builders are flexible to integrate either SAS or SATA devices and slash the costs associated with supporting two separate interfaces.

U.S. Pat. No. 6,942,524 discloses a SAS connector for SAS 2.0 standard transmitting 6.0 Gbps. Higher signal transmission is a tendency in high speed industry. Connectors adapted for speed higher than 6.0 Gbps is developing. Questions of electrical performance, such as cross talk, signal attenuation arises. Particularly, crosstalk is a major issue at 12 Gbps. So, we hope design an electrical connector to overcome said question.

SUMMARY OF THE INVENTION

Accordingly, an object of the present invention is to provide electrical connectors capable to 12 Gbps.

In order to achieve the object set forth, an electrical connector comprises an insulating housing defining an uninterrupted tongue portion with opposite first surface and second surface and a plurality of contacts loaded in the tongue portion. The first surface defines at least one rib. The plurality of contacts comprise a first group of contacts with contacting portions loaded in the first surface at one side of the at least one rib, a second group of contacts with contacting portions loaded in the first surface at another side of the rib and a third group of contacts with contacting portions loaded in the second surface opposite to the at least one rib. Each of the second and third group of contacts is composed of signal contacts and grounding contacts. The grounding contacts of each group unitarily connect with each other by a connecting bar at front distal ends thereof.

Other objects, advantages and novel features of the invention will become more apparent from the following detailed description when taken in conjunction with the accompanying drawings.

DETAILED DESCRIPTION OF THE INVENTION

Reference will now be made in detail to the preferred embodiment of the present invention.

Figure 1:
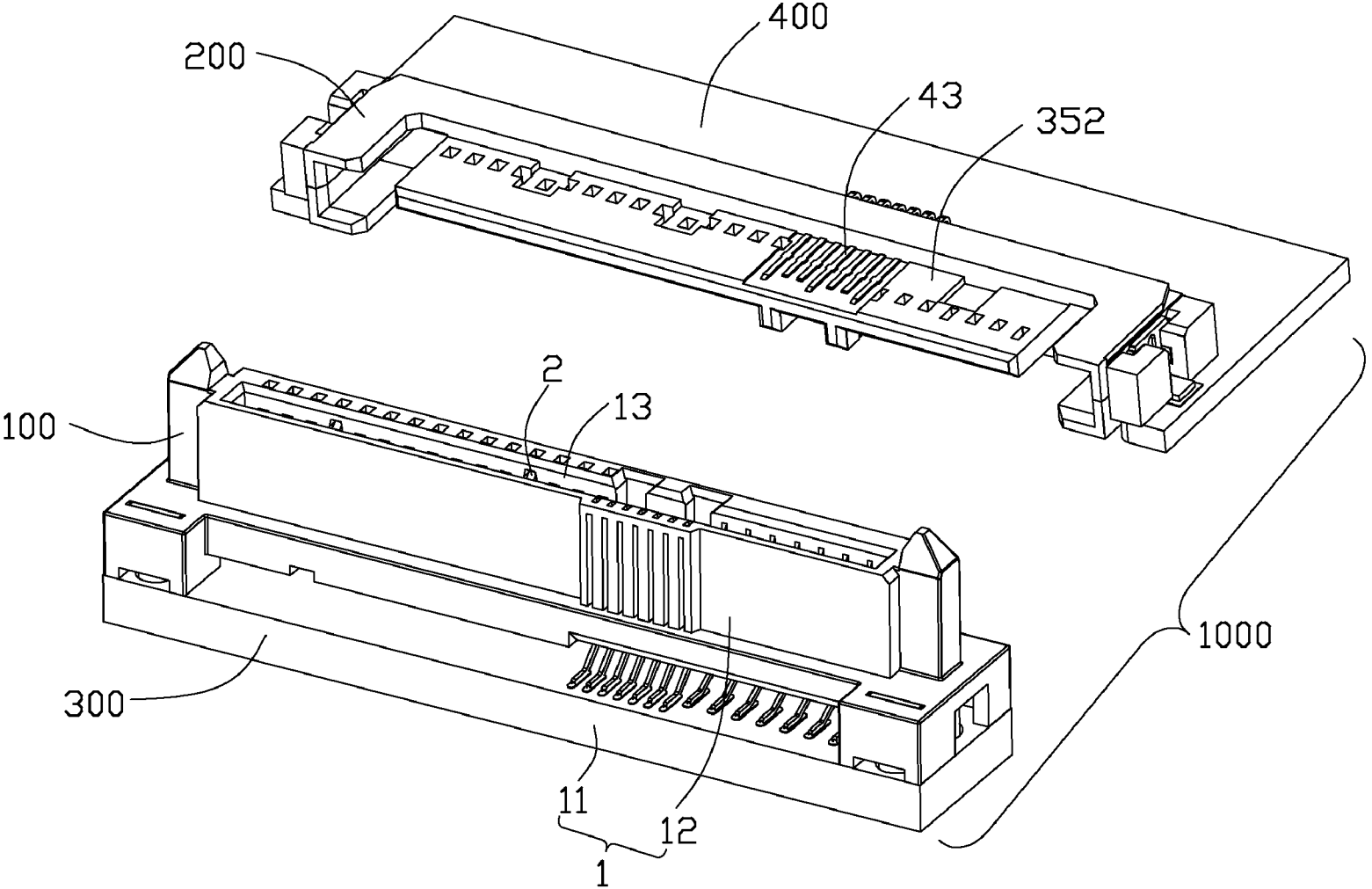
FIG. 1 is a perspective view of an electrical assembly of a first embodiment in accordance with the present invention, the electrical assembly including a first electrical connector and a second mating electrical connector mounted on PCBs respectively.

Referring to FIG. 1, an electrical connector assembly 1000 including a first electrical connector 100 vertically mounted on a first circuit board 300 and a second electrical connector 200 right-angle mounted on a second circuit board 400 is illustrated. The electrical connectors 100, 200 are used for providing interfaces for a high speed storage device, especially for SAS signal transmission which is capable to 12 Gbps operation.

Figure 2:
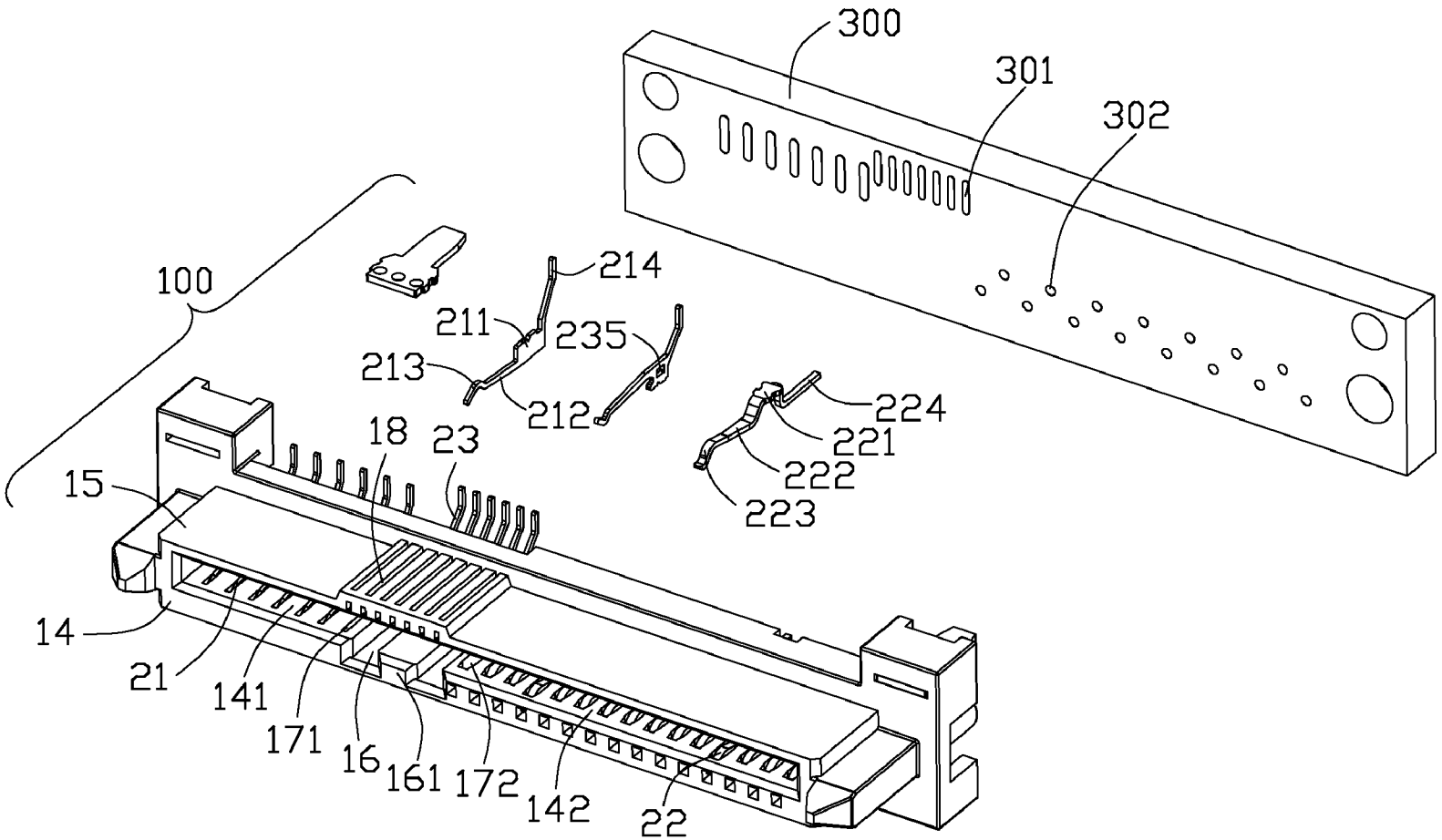
FIG. 2 is an exploded perspective view of the first electrical connector and a first PCB shown in FIG. 1.

Referring to FIGS. 1 and 2, the first electrical connector 100 includes an insulated housing 1 including a base portion 11 and a mating portion 12 projecting from a top face of the base portion, and a plurality of contacts 2 assembled to the insulated housing 1. The insulated housing 1 defines a longitudinal uninterrupted slot 13 extending in a first direction and a second direction through the front face and surrounded by two parallel first and second sidewalls 14, 15. The first sidewall 14 is divided at an inside surface thereof, to two separated parts by a groove 16 without any conductive contacts and extending through the front face in the second direction. The groove 16 unitarily defines a partitioning rib 161 therein which is co-plane with the inside surface of the first sidewall and extending in the second direction. The first part 141 is loaded with a group of seven first conductive contacts 21 in corresponding passageways 171 not through the front face, which is functioned as a signal segment S1-S7 defined in SAS 2.0 Specification. The second part 142 is loaded with a group of fifteen second conductive contacts 22 in the passageways 172 through the front face of the mating portion, which is functioned as a power segment P1-P15 defines in SAS 2.0 Specification.

The second sidewall 15 defines an expanding portion 18 heighten in a third direction perpendicular to the first and second directions. The expanding portion is aligned with the grooves 16. The expanding portion 18 is loaded with seven conductive contacts 23 in the passageways 181 through the front face and through the second sidewall 15 in the third direction, which is functioned as a signal segment S8-S14 defines in SAS 2.0 Specification.

The contacts in every segment have a same configure. The first and the third conductive contacts 21, 23 have a same shape, arranged mirror to each other. So the same contacts are only introduced one time. The first conductive contact 21 of a vertical type by cutting a metal sheet and includes a board retaining portion 211 with barbs at a top edge thereof, an elastic arm 212 with an inward-converted contacting portion 213 at a freed end thereof and a tail portion 214 extending opposite to the projection direction of the contacting portion 213. The elastic portion 212 and the tail portion 214 extend from opposite lateral sides of the retaining portion 211. The third contact 23 further defines an open 235 in a centre thereof which not only adjusts matching impedance but also interlocks with housing for securing (not shown). The first and third conductive contacts 21, 23 are formed by cutting in the metal sheet, i.e., the contacting portion 213 is formed at a cutting face of the metal sheet and the barbs extend from the cutting face. The contacting portion 213 defines a mating or elastic enforce orientation which is parallel to the retaining portion 211.

The second conductive contacts 22 is of a horizontal type which is made by cutting and bending a metal sheet, which includes a retaining portion 221 with barbs at opposite lateral sides of the retaining portion, an elastic arm 222 with an inward-converted contacting portion 223 at a freed end thereof and the tail portion 224. The elastic arm 222 and the tail portion 224 extend from opposite ends of the retaining portion 221. The contacting portions 223 also define a mating orientation parallel to the mating orientation of the first and the third contacts. Since the contacts 2 are mated with the second connector 200 through the slot 13, the mating orientation of all contacts is common defined along the same mating orientation. The retaining portions 221 of the second conductive contacts 22 are perpendicular to the mating orientation and the contacting portions 223 are formed in metal sheet plane, not the cutting face. The tail portions of the first and the third conductive contacts are soldered to conductive pads 301 of the PCB by SMT while the tail portions of the second conductive contacts are by through holes 302.

Figure 3:
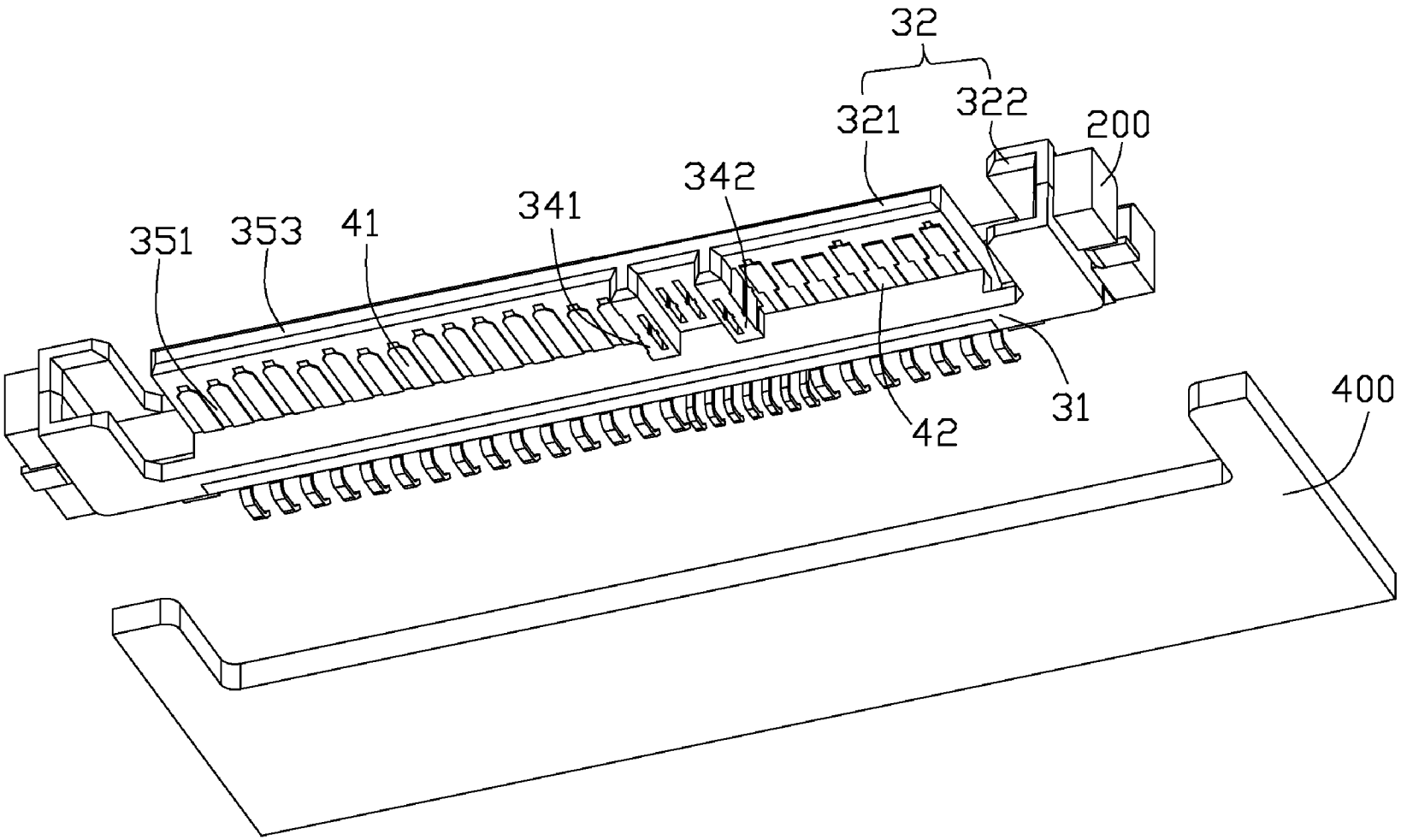
FIG. 3 is an exploded perspective view of the second electrical connector and a second PCB shown in FIG. 1.
Figure 4:
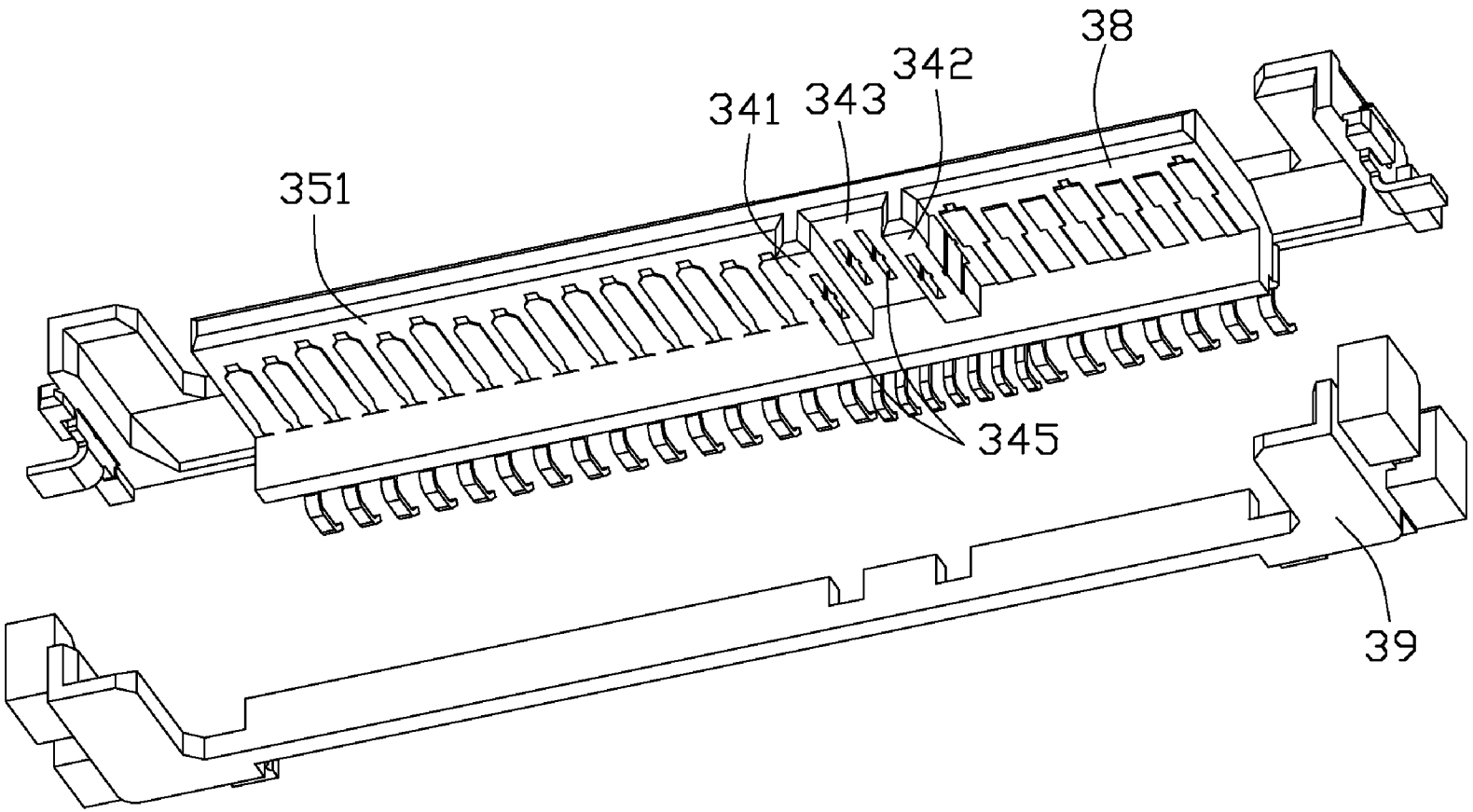
FIG. 4 is an exploded perspective view of the second electrical connector.
Figure 5:
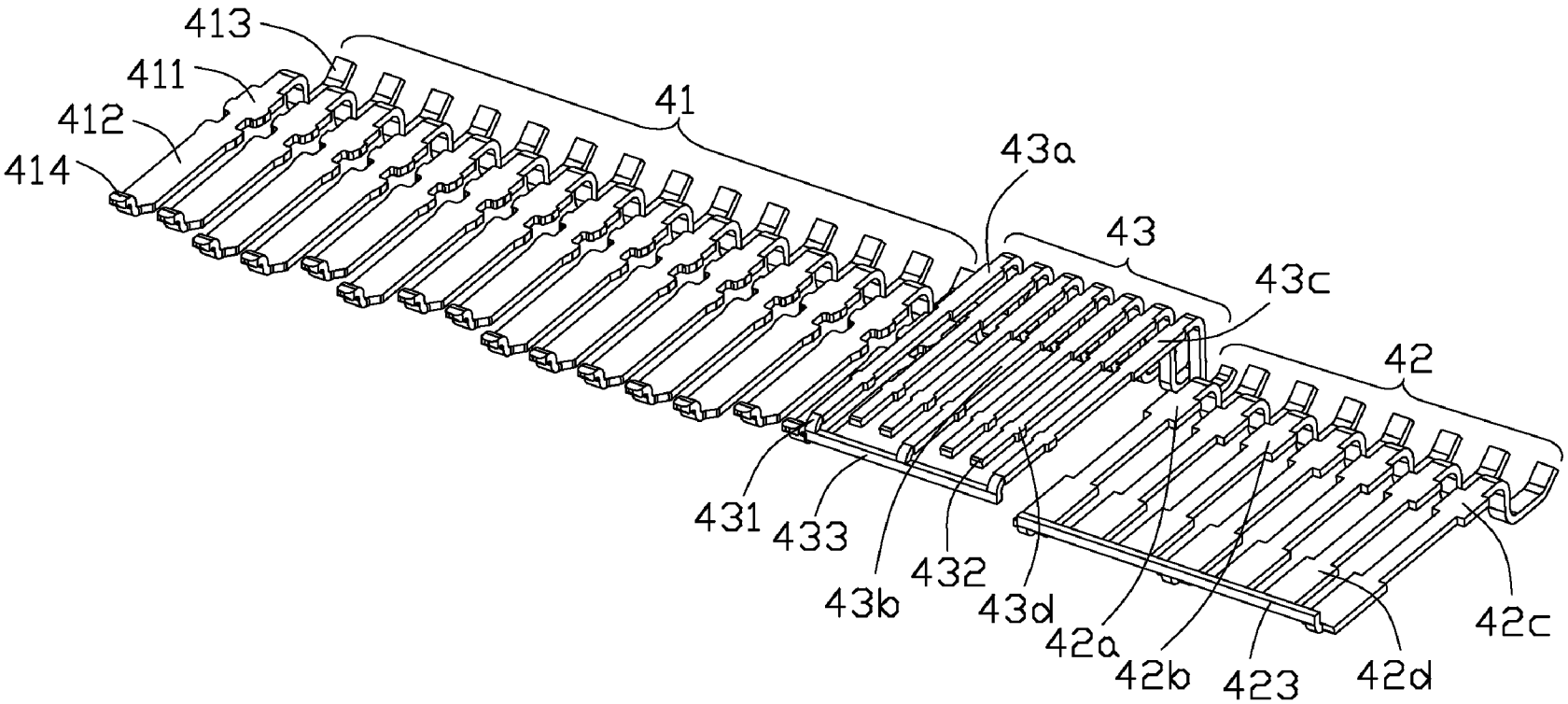
FIG. 5 is a perspective view of contacts of the second electrical connector.

Referring to FIGS. 3 through 5, the second electrical connector 200 intended to mate with the first electrical connector 100, include a rear wall 31 and a mating portion 32 which is formed by an uninterrupted tongue portion 321 and a pair of guiding portions 322 of an inverted U shape commonly extending from the rear wall 31. The tongue portion 321 defines two ribs 341, 342 at a first surface 351 thereof unitarily extending forwards from the rear wall 31 to a front face 353, the ribs 34 divides the first surface 351 to two sections, one being larger than the other section. The ribs 34 and said two sections incorporate with the groove 16 and the two parts of the first electrical connector 100. The contacts 41, 42, 43 loaded in the first and second surface of the tongue portions 321 are defined same to arrangement and designation of the contacts 21, 22, 23 of the first electrical connector 100, so description of the functions of the contacts of the second connector 200 is omitted.

Combination with FIG. 1, the group of first contacts 41 located in left section of the first surface 351 are intend to mate with the first contacts 21 of the first electrical connector 100, which is named as power segment, while the group of second contacts 42 located in the right section of the first surface 351 intend to mate with the second contacts of the first electrical connector, which is named as a signal segment. The group of third contacts 43 loaded in the second surface 352 of the tongue portion. Said contacts of three groups are of plane shape, each substantially includes a plate section retained in the insulating housing and a leg section 413 perpendicularly bending from the plate section and then bending rearward to press against conductive pads (not shown) on the second PCB. The plate section include a retaining portion 411 with barb at lateral sides thereof and a contacting portion 412 extending from the retaining portion 411 which is received in the passageways (not labeled) defined on the first and second surface of the tongue portion 321 and expose to an exterior in a direction perpendicular to the surfaces of the tongue portion 321. Please notes, the first contacts 41 are wider than the second and third contacts 42, 43. Each of all of the first contacts 41 further includes a bending tip 414 at the front distal end of the contacting portion 412 which slants toward the second surface 352 and embedded in the insulating housing.

Please note, either of the second and the third contacts is arranged in a pattern with G-S(+)-S(−)-G-S(+)-S(−)-G-S(+)-S(−). So three contacts of each group of contacts are of grounding contacts, which are labeled with numerals 43*a*, 43*b*, 43*c*, 42*a*, 42*b*, 42*c*. The signal contacts are labeled with numerals 43*d*, 42*d*. Three grounding contacts 43*a*, 43*b*, 43*c* of the third contacts 43 are connecting with each with a unitary connecting bar 433 which connect with distal ends 431 thereof. The distal ends of the grounding contacts slant downwards toward the first surface 351 since the third contacts 43 are loaded at the second surface 352. Free distal ends 432 of the signal contacts of the third contacts 43 do not bend in this embodiment and are disposed behind the connecting bars 433 with a distance. The connecting 433 bar are disposed adjacent to the front surface 353 while do not explode to the front face, and the connecting bar 433 is in a vertical statue substantially. The distal ends 431 are adjustable according the height of the tongue portion to dispose the connecting bar. Three grounding contacts 42*a*, 42*b*, 42*c* of the second contacts also define a connecting bar 423 at distal ends thereof to unitarily connecting said three grounding contacts together.

As best shown in FIG. 4, the second electrical connector 200 is construed with two separated portions, a base portion 38 forming the rear wall 31, tongue portion 321 and half of the guiding portion and an assist portion 39 attached to the bottom of the base portion 38 and forming another half of the guiding portion. Said two ribs 341, 342 are spaced from each other a spaced groove 343 therebetween. The space groove just is adapted for receiving the partitioning rib 161. Said three elements define slits 345 through the first surface 351 of the tongue portion.

The connecting bars 433,423 connecting the grounding contacts of the two signal segments add short pass between signal return pass which will reduces the crosstalk. Therefore, the electrical connector assembly 1000 can be used to transport high speed up to 12 Gbps. Moreover, the first and second electrical connector is same to the designation of the connectors in SAS 2.0 Specification in dimension and pin arrangement which has a high speed capable to 6 Gbps except the addition of the grounding bars. Using a same interface, the connectors of this present invention speed signal transmission up to 12 Gbps.

Figure 6:
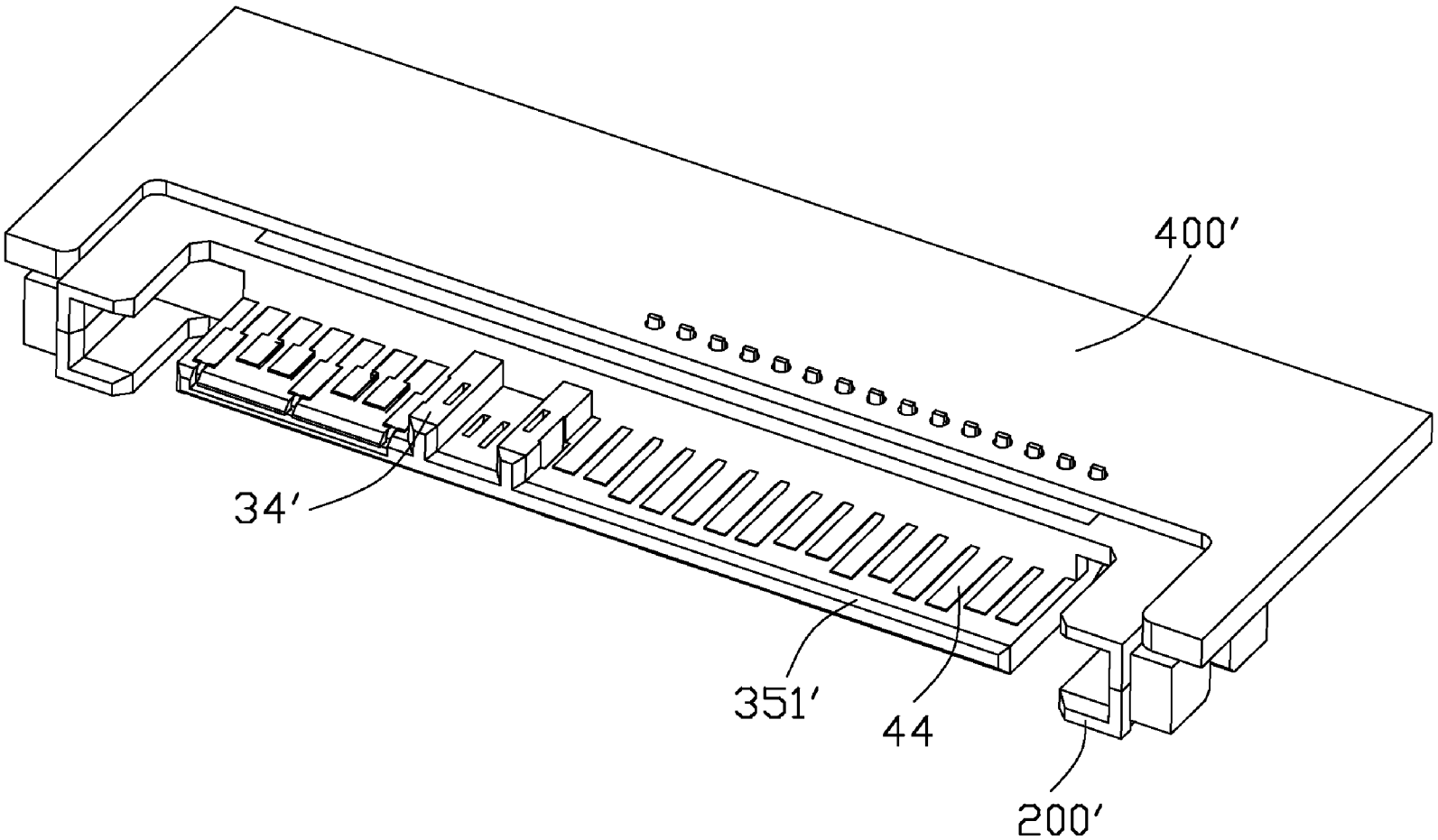
FIG. 6 is a perspective view of a second electrical connector of a second embodiment in accordance with the present invention which is mounted on a PCB.
Figure 7:
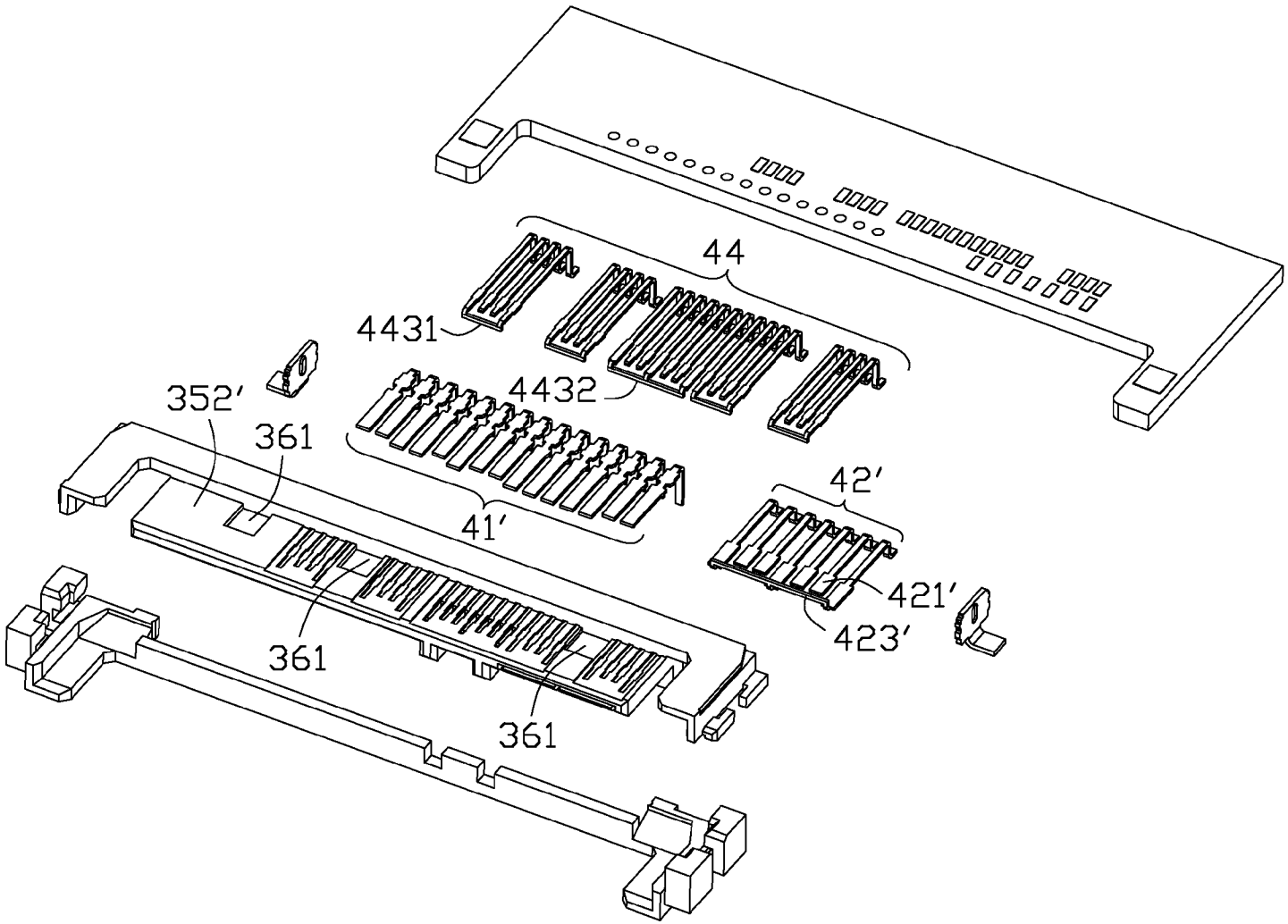
FIG. 7 is an exploded perspective view of the second electrical connector show in FIG. 6.

FIGS. 6 and 7 show a second embodiment of the invention, which give an illustration of a second connector 200' which is similar to the second connector of the first embodiment wherein description of same and similar element are omitted. The second electrical connector is mounted on a PCB 400' and comprises two ribs 34' on the first surface 351' of the tongue portion. The first surface are disposed with a group of power contacts 41' and a group of signal contacts 42', wherein three grounding contacts of the group of signal contacts are connecting with each other by a connecting bars 423' at distal ends thereof. Contacting portions 421' of the signal contacts are enlarged at front portion to meet high frequency performance. The second surface 352' opposite to the first surface 351' are loaded with a group of signal contacts 44 which has more contacts than the third contacts 43 of the first embodiment. Please note, the second surface defines a plurality of shallow recesses 361 thereof which are used to lock with a complementary connector. Therefore, the group of signal contacts 44 are located to avoid the shallower recesses 361 and the contacts arrangement still follow the principles that every pair of differential signal contacts are located between two grounding contacts. So, two grounding contacts are connecting with each other by a connecting bar 4431 and three grounding contacts are also connecting with each other by a connecting bar 4432. In other embodiment if allow, the connecting bars can connect different numbers of the grounding contacts.

Figure 8:
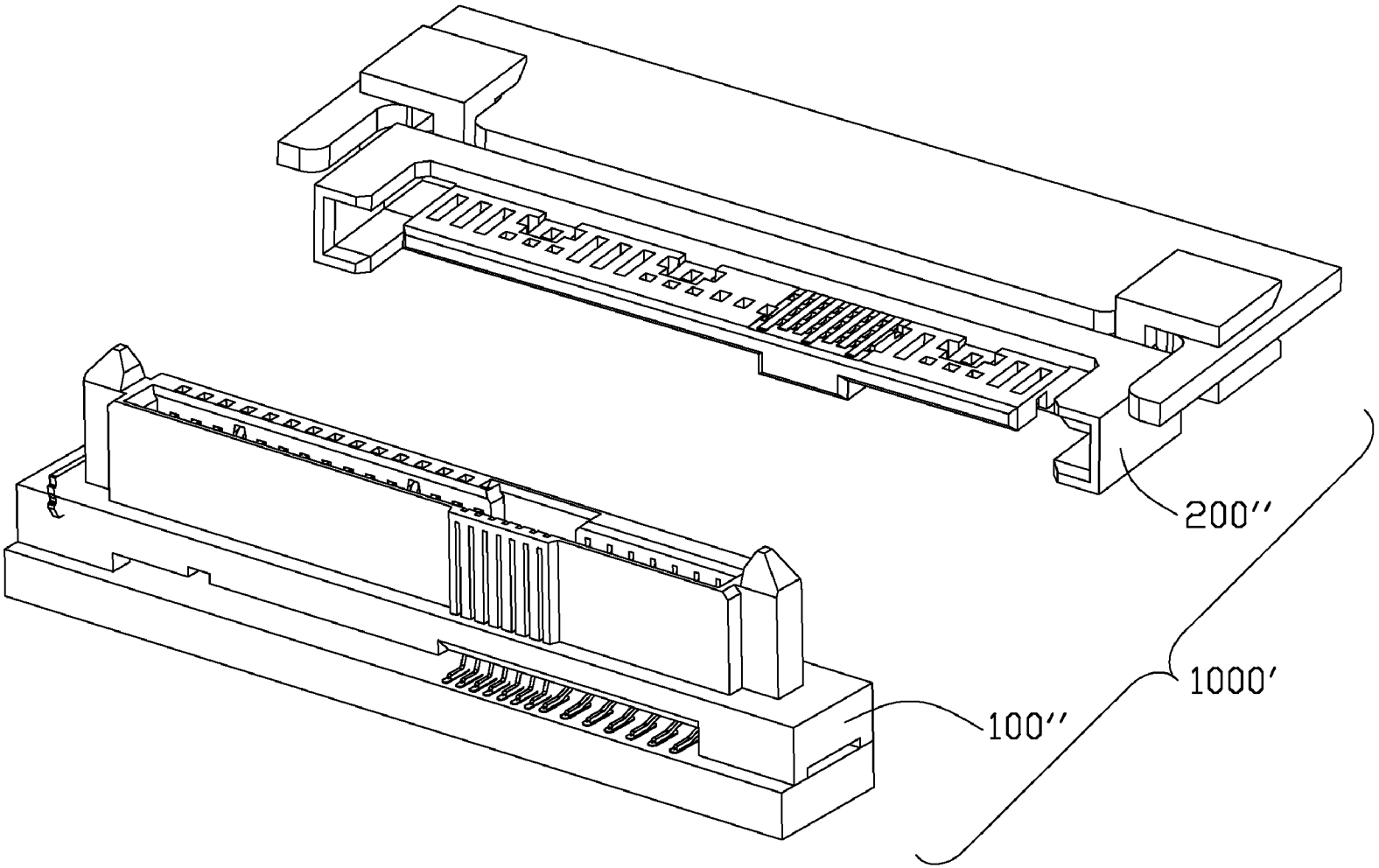
FIG. 8 is a perspective view of an electrical connector assembly of a third embodiment in accordance with the present invention, the electrical assembly including a first electrical connector and a second mating electrical connector mounted on PCBs respectively.
Figure 9:
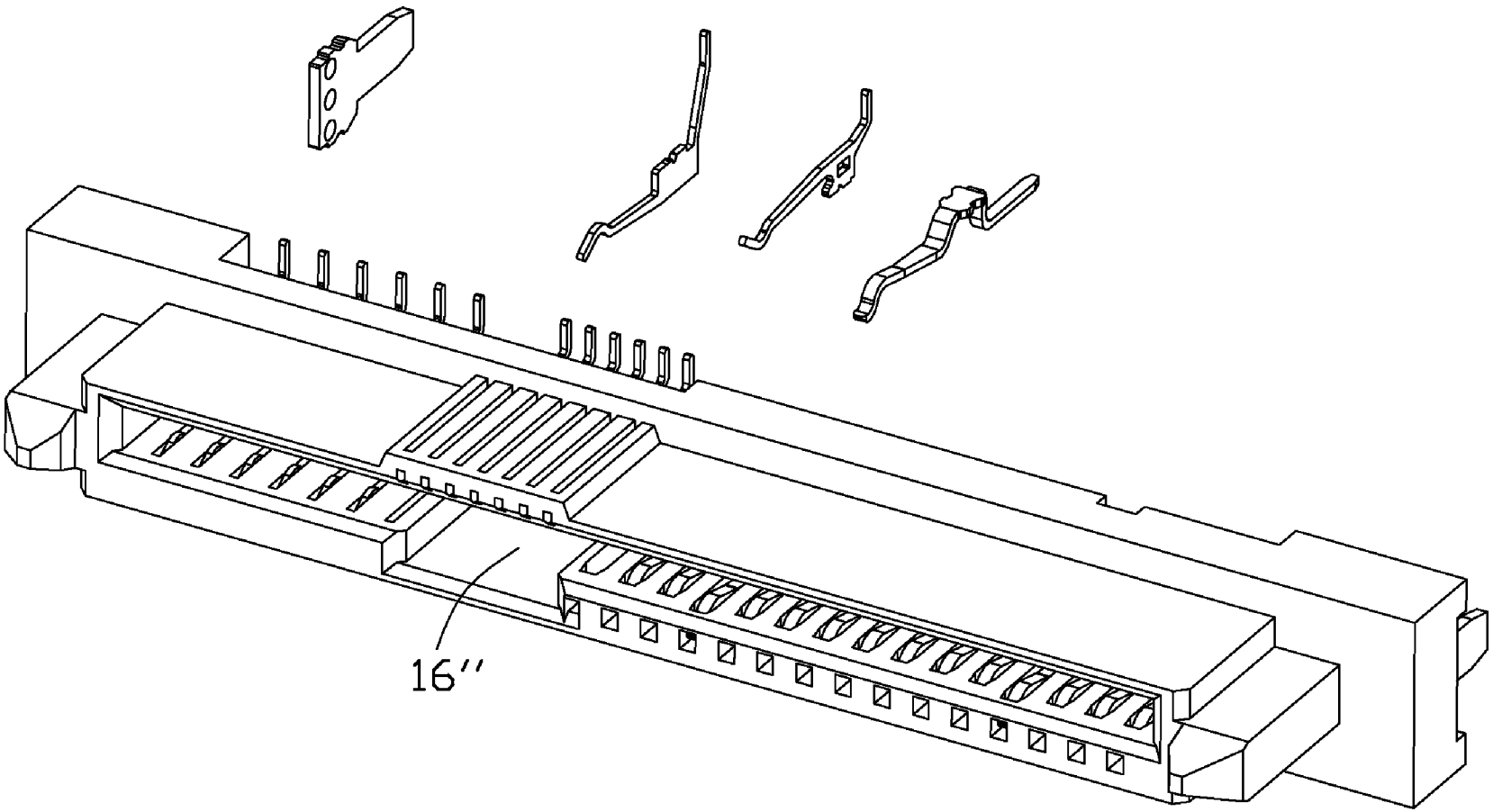
FIG. 9 is an exploded perspective view of the first electrical connector.
Figure 10:
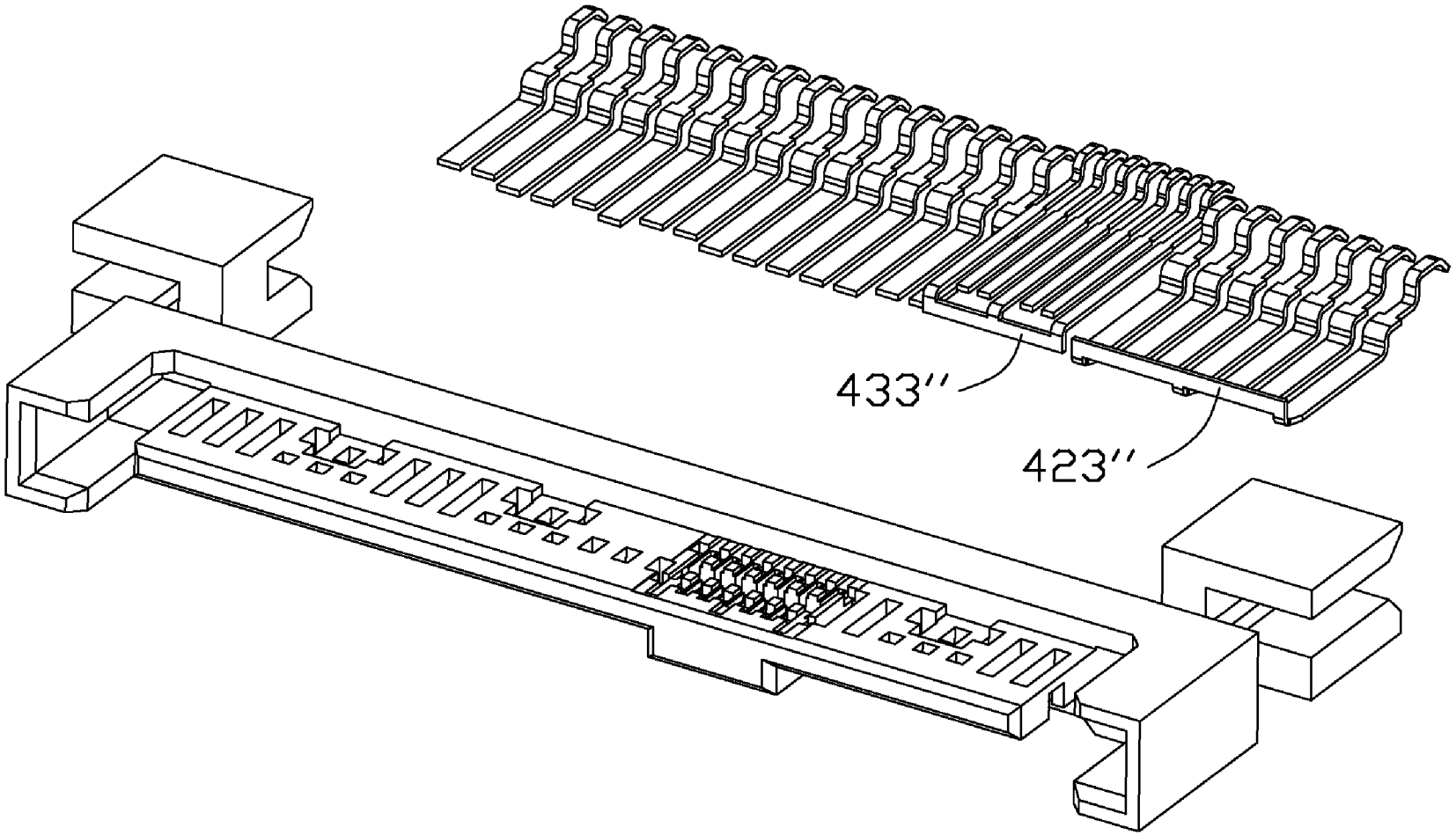
FIG. 10 is an exploded perspective view of the second electrical connector.

FIGS. 8 through 10 show a third embodiment of the invention, which give an illustration of an electrical connector assembly 1000" wherein description of same and similar element are omitted. The first electrical connector 100" has no partition rib as shown in first embodiment in the groove 16". The second electrical connector 200" is made from unitarily insulating housing. The grounding contacts of signal contact group are connecting with a connecting bars 423"/433".

It is to be understood, however, that even though numerous characteristics and advantages of the present invention have been set forth in the foregoing description, together with details of the structure and function of the invention, the disclosure is illustrated only, and changes may be made in detail, especially in matters of shape, size, and arrangement of parts within the principles of the invention to the full extent indicated by the broad general meaning of the terms in which the appended claims are expressed.

We claim:

1. An electrical connector comprising:

an insulating housing defining an uninterrupted tongue portion with opposite first surface and second surface, the first surface defining at least one rib;

a plurality of contacts loaded in the tongue portion, and comprising a first group of contacts with contacting portions loaded in the first surface at one side of the at least one rib, a second group of contacts with contacting portions loaded in the first surface at another side of the rib and a third group of contacts with contacting portions loaded in the second surface opposite to the at least one rib;

wherein each of the second and third group of contacts is composed of signal contacts and grounding contacts;

wherein the grounding contacts of each group unitarily connect with one another by a connecting bar at front distal ends thereof;

wherein each of the connecting bars is perpendicular to the first and second surfaces of the tongue portion, and parallel and adjacent to a front face of the tongue portion, and is hidden in the tongue portion and not exposed to said front surface of said tongue portion.

2. The electrical connector as claimed in claim 1, wherein the connecting bars are integrally embedded in tongue portion adjacent to said front face of the tongue portion.

3. An electrical connector assembly for mounting to a printed circuit board, comprising:

an elongated insulative housing defining a lengthwise direction and a transverse direction perpendicular to the lengthwise direction;

a mating port formed in the housing along said lengthwise direction and forwardly communicating with an exterior in a front-to-back direction perpendicular to said lengthwise direction and said transverse direction; and a set of contacts including at least two differential pair contacts for signal transmission and three grounding contacts alternately arranged with each other along the lengthwise direction; wherein a connecting bar extends along the lengthwise direction and is linked at and unitarily formed with front ends of said three grounding contacts; wherein the housing defines a mating tongue in the mating port, and the contacting define corresponding contacting sections exposed upon the mating port under condition that said connecting bar is essentially hidden in a front edge of the mating tongue; wherein the contacts are integrally formed with the housing via insert molding;

wherein the housing includes a first part and a second part discrete from each other while being assembled together in the transverse direction under condition that the contacts are integrally formed with the first part via insert molding.

4. The electrical connector assembly as claimed in claim 3, wherein the mating port is defined by both said first part and said second part cooperatively in the transverse direction while each of said first part and said second part defines the mating port essentially whole in the lengthwise direction.

5. The electrical connector assembly as claimed in claim 4, wherein the second part is closer to the printed circuit board than the first part.

6. The electrical connector assembly as claimed in claim 5, wherein the printed circuit board defines a cutout, and the first part is at least partially embedded in said cutout.

7. The electrical connector assembly as claimed in claim 3, wherein the mating port defines at least one rib, and said second part defines a notch receiving said rib therein.

8. The electrical connector assembly as claimed in claim 3, further including another set of contacts composed of other two differential pair contacts for signal transmission and other three grounding contacts alternately arranged with each other, wherein the set of contacts are exposed upon one surface of the mating tongue while said another set of contacts are exposed upon an opposite surface of the mating tongue.

9. The electrical connector assembly as claimed in claim 3, wherein the connecting bar is essentially located at a different level with regard to the contacting sections in the transverse direction.

10. An electrical connector assembly comprising:

an insulative housing defining a lengthwise direction and a transverse direction perpendicular to each other;

said housing defining a mating tongue extending along the lengthwise direction and defining opposite first and second surfaces in said transverse direction;

a first group of contacts disposed in the housing with first contacting sections exposed on the mating tongue, said first group of contacts including first differential pair contacts and first grounding contacts; and a second group of contacts disposed in the housing with second contacting sections exposed on the mating tongue, said second group of contacts including second differential pair contacts and second grounding contacts; wherein the two outermost ones of said first group of contacts are the first grounding contacts to enclose the first differential pair contacts therebetween in the lengthwise direction under condition that a first connection bar connects to said two outermost ones of the first group of contacts; the two outermost ones of said second group of contacts are the second grounding contacts to enclose the second differential pair contacts therebetween in the lengthwise direction under condition that a second connection bar extends in the lengthwise direction and connects to said two outermost ones of the second group of contacts; wherein said first group of contacts and said second group of contacts are directly neighboring to each other without any other contacts therebetween in said lengthwise direction; wherein both the first group of contacts and the second group of contacts include corresponding contacting sections exposed upon a same face of said mating tongue, and a pair of ribs are formed on an opposite face of the mating tongue, said pair of ribs being spaced from each other in the lengthwise direction while each of said pair of ribs extending in a front-to-back direction perpendicular to both said lengthwise direction and said transverse direction.

11. The electrical connector assembly as claimed in claim 10, wherein the first contacting sections and the second contacting are both exposed upon the first surface of the mating tongue.

12. The electrical connector assembly as claimed in claim 10, wherein the first connecting bar is located at a level different from that of the first contacting sections, and the second connecting bar is located at a level different from that of the second contacting sections while same with that of the first connecting bar.

13. The electrical connector assembly as claimed in claim 12, wherein the first contacting sections are exposed upon the first surface while the second contacting sections are exposed on the second surface.

14. The electrical connector assembly as claimed in claim 10, wherein no contacts are located between said two ribs.

15. The electrical connector assembly as claimed in claim 14, wherein the ribs define therein corresponding slots extending in said front-to-back direction while having closed type front and rear ends in said front-to-back direction.

16. The electrical connector assembly as claimed in claim 15, wherein the slots are exposed to an exterior along the transverse direction.

* * * * *